United States Patent [19]

Verkhovykh et al.

[11] 3,987,222

[45] Oct. 19, 1976

[54] METHOD OF SURFACE-STRENGTHENING OF STEEL PARTS WORKING IN ABRASION

[76] Inventors: Petr Mikhailovich Verkhovykh, prospekt Lenina, 44/14, kv. 56; Viktor Ivanovich Yakovlev, prospekt Lenina, 47/12, kv. 61; Alexei Fedorovich Aakitin, ulitsa Rabochaya, 11, kv. 19; Viktor Fedorovich Alexandrov, ulitsa Sovetskaya, 22, kv. 29; Nikolai Afanasievich Miroshkin, ulitsa Trudovaya, 19, kv. 86, all of Elektrostal Moskovskoi oblasti, U.S.S.R.

[22] Filed: June 20, 1975

[21] Appl. No.: 588,953

[52] U.S. Cl. ..... 427/354; 427/374 R; 427/435; 148/6.11; 148/6.24

[51] Int. Cl.[2] ..... C23F 7/24

[58] Field of Search ..... 148/6.24, 6.11, 6.17, 148/6.21; 427/435, 374, 354

[56] References Cited

UNITED STATES PATENTS

| | | | |
|---|---|---|---|
| 2,609,342 | 9/1952 | White et al. | 252/25 |
| 2,622,993 | 12/1952 | McCullough | 148/6.24 X |
| 2,905,574 | 9/1959 | Spengler | 427/226 |

FOREIGN PATENTS OR APPLICATIONS

| | | |
|---|---|---|
| 626,352 | 8/1961 | Canada |

*Primary Examiner*—Ralph S. Kendall
*Attorney, Agent, or Firm*—Haseltine, Lake & Waters

[57] ABSTRACT

The method consists in preparing a mixture composed of 20–80 g of molybdenum disulphide and 1–5 g of sulphuric acid per liter of glycerine, heating said mixture from 180° to 230° C, holding the workpieces in said mixture for 3–7 hours in presence of brass, followed by washing the parts with a cooling liquid and drying them.

2 Claims, No Drawings

METHOD OF SURFACE-STRENGTHENING OF STEEL PARTS WORKING IN ABRASION

The present invention relates to the methods of surface-strengthening of steel parts working in abrasion by diffusive saturation of said parts.

The present invention can be used most efficiently in the machine-building industry for making parts from heat-resistant, structural and carbon steels, working in abrasion.

Such parts include punches and dies of the die sets, draw plates, plunger-and-barrel pairs of fuel pumps, pins of automotive steering gear and piston pins of I.C. engines.

Widely known at present are the methods of surface-strengthening of steel parts working in abrasion wherein the surfaces of these parts are protected by special coatings.

These methods consist in preparing a mixture composed of a metal applied to the surface of the workpieces and a binder, heating this mixture and holding the workpieces therein, followed by washing and drying.

The U.S. Pat. No. 3,184,330, USA, covers a method of diffusive saturation of parts according to which the workpieces are immersed in a melt composed of 10 wt.-% of calcium and such uncombined diffusing elements as molybdenum, zinc, titanium, niobium, vanadium, cerium or helium. This melt is heated from 800° C to the melting point of the workpieces.

This method is efficient in strengthening the surface of the workpieces.

However, the diffusive saturation of parts according to this method calls for heating the melt to very high temperatures reaching for over 800° C. This raises the cost of the process, may distort the shape of the workpieces and requires slow cooling of parts to protect their integrity.

Known in the art is a method of surface-strengthening of metallic parts consisting in preparing a mixture composed of molybdenum disulphide and a binder, e.g., sodium silicate in combination with xylene, heating said mixture to 300° C and holding the workpieces in it followed by washing and drying.

This method calls for a lower temperature and is, therefore, more economical than the previous one; it does not distort the profile of the workpieces and allows their rapid cooling thus cutting down the time of their treatment.

However, this method fails to ensure long service life of the parts treated in this manner.

Besides, this method requires costly and scarce components of the mixture.

In view of the rapid development of machine building and a growing demand for high-quality products made of abrasive materials by pressing, there developed a problem of improving the wear resistance of the surfaces of parts working in abrasion, e.g. dies and punches of die sets, and prolonging the service life of I.C. engines.

The known methods of surface-strengthening of metal parts cannot produce the coatings which would satisfy the ever-growing demands for higher wear resistance of parts and for improving the quality of the products made thereof.

The basic problem consists in selecting the components of the mixture whose properties would speed up the process of diffusion, increase the strength and quality of the applied coating, reduce the labour involved and the manufacturing and finishing costs.

The main object of the present invention is to provide a method of surface-strengthening of steel parts working in abrasion which would improve the wear resistance of the treated surfaces of parts.

Another no less important object of the invention is to improve the quality of the products made from the parts treated by the method according to the invention, this being achieved by improving the surface of the parts and imparting the desired shape to them.

Still another object of the invention is to reduce the treatment costs of the parts by using cheaper components of the mixture than those employed in the known methods.

These objects are accomplished by providing a method of surface strengthening of steel parts working in abrasion which consists in preparing a mixture composed of molybdenum disulphide and a binder, heating said mixture, immersing the workpieces into said mixture, holding said parts in said mixture followed by their washing and drying wherein, according to the invention, the mixture is made of 20–80 g molybdenum disulphide and 1–5 g of sulphuric acid per liter of glycerine, then the obtained mixture is heated to 190°–230° C, the workpieces are immersed into said mixture and held therein for 3 to 7 hours in presence of metallic brass.

This composition and the proportion of the mixture components ensure a higher diffusive saturation ability of the molybdenum disulphide coating of the surfaces of parts working in abrasion while the procedures used in implementing the method improve the wear resistance of the rubbing surfaces of parts.

If the amount of molybdenum disulphide per liter of glycerine is less than 20 g, the layer of coating on the surface of parts will be thin and liable to wear out quickly thus reducing the service life of the parts.

If the amount of molybdenum disulphide per liter of glycerine exceeds 80 g, the surface of the parts will be covered with a weak surplus layer of coating which scales off from the surface of parts thus involving a risk of jamming of the matching parts.

If the amount of sulphuric acid per liter of glycerine is smaller than 1 g, this will slow down the formation of coatings on the parts thus increasing the time of holding the workpieces in the mixture.

If the amount of sulphuric acid per liter of glycerine exceeds 5 g, this will impair the properties of glycerine and intensify pickling of the surfaces of workpieces which will distort their dimensions.

If the process is caried out at temperatures below 190° C, this will impair the diffusive saturation of the surfaces of parts.

The use of temperatures above 230° C during surface-strengthening is objectionable since glycerine in this case may get self-ignited.

The selected time of holding the workpiece in said mixture (3–7 hours) produces a surface coating possessing high anticorrosion and antifriction properties.

If the workpieces are held in the mixture for a period less than three hours, the coating will be too thin and liable to be worn out quickly.

Holding the parts in the mixture in excess of 7 hours will produce a surplus layer of coating on their surface.

The parts are coated in presence of metallic brass functioning as a catalyst contributing to the decomposition of molybdenum disulphide and formation of a wear-resistant surface layer on the surface of a steel part.

It is practicable that the workpieces should be placed into a basket made of brass wire and immersed together with said basket into the mixture.

The basket facilitates immersion of the workpieces into, and taking them out of, the mixture.

Now the invention will be described in detail by way of examples of the method of surface-strengthening of parts working in abrasion, according to the invention.

EXAMPLE 1

A liter of glycerine is mixed with 20 g of molybdenum disulphide and 1 g of sulphuric acid, and the obtained mixture is heated to 190° C; then the workpieces in the form of rings slipped on bar-type brass suspensions are dipped into the mixture, held therein for 3 hours, washed in cold water and dried.

This treatment has increased the wear resistance of the carbon steel parts of die sets from 20 to 30 per cent.

EXAMPLE 2

A liter of glycerine is mixed with 80 g of molybdenum disulphide and 5 g of sulphuric acid and the obtained mixture is heated to 230° C; then the workpieces places into a brass wire basket are immersed into said mixture, held therein for 7 hours, washed in cold water and dried.

This treatment has raised the wear resistance of tool steel parts from 50 to 60 per cent.

EXAMPLE 3

A liter of glycerine is mixed with 50 g of molybdenum disulphide and 2 g of sulphuric acid and the obtained mixture is heated to 220° C; then the workpieces placed into a brass wire basket are immersed into said mixture, held therein for 5 hours, washed in cold water and dried. This has proved to be the best version of the method according to the invention.

This method of coating the small parts of die sets made of tool steels and heat-resistant steels has increased their wear resistance by 2–3 times and 3–4 times respectively and ensured a high quality of the products in which said parts are utilized.

The method according to the invention makes it possible to dispense with lubrication of the working surfaces of the dies and punches of the die sets used for manufacturing products from abrasive materials.

The highest effect yielded by the employment of the method according to the invention has been obtained in treating the the parts made of heat-resistant steel, e.g., punches, dies, draw plates and mandrels.

What we claim is:

1. A method for surface-strengthening of steel parts working in abrasion which consists in preparing a mixture composed of 20 to 80 g of molybdenum disulphide and 1 to 5 g of sulfuric acid per liter of glycerine, heating said mixture to 190°–230° C, immersing said steel parts into said mixture, holding them therein for 3 to 7 hours in the presence of brass, washing them in a cooling liquid and drying.

2. A method according to claim 1 wherein the steel parts are placed into a brass wire basket and immersed into said mixture.

* * * * *